US006666521B1

(12) United States Patent
Pease et al.

(10) Patent No.: US 6,666,521 B1
(45) Date of Patent: Dec. 23, 2003

(54) SYSTEM FOR CONTROLLING CUTTING HORIZONS FOR CONTINUOUS TYPE MINING MACHINES

(75) Inventors: Robert E. Pease, Huntsville, AL (US); John W. Ramsden, Jr., Owens Cross Roads, AL (US)

(73) Assignee: American Mining Electronics, Inc., Huntsville, AL (US)

( * ) Notice: Subject to any disclaimer, the term of this patent is extended or adjusted under 35 U.S.C. 154(b) by 0 days.

(21) Appl. No.: 10/027,508

(22) Filed: Dec. 21, 2001

Related U.S. Application Data

(63) Continuation-in-part of application No. 09/309,772, filed on May 11, 1999, now abandoned.

(51) Int. Cl.[7] ..... E21C 35/08
(52) U.S. Cl. ..... 299/1.1; 299/1.05
(58) Field of Search ..... 299/1.05, 1.1, 299/1.2, 1.6

(56) References Cited

U.S. PATENT DOCUMENTS

| | | | | |
|---|---|---|---|---|
| 4,200,335 A | | 4/1980 | Moynihan et al. | 299/1 |
| 4,228,508 A | * | 10/1980 | Benthaus | 299/1.6 X |
| 4,262,964 A | | 4/1981 | Ingle et al. | 299/1 |
| 4,634,186 A | | 1/1987 | Pease | 299/1 |
| 4,952,000 A | | 8/1990 | Lipinski et al. | 299/1 |
| 4,968,098 A | * | 11/1990 | Hirsch et al. | 299/1.1 |
| 4,981,327 A | | 1/1991 | Bessinger et al. | 299/1 |
| 5,106,162 A | | 4/1992 | Lewins et al. | 299/10 |
| 5,188,426 A | | 2/1993 | Stolarczyk et al. | 299/1.2 |
| 5,228,751 A | | 7/1993 | Ramsden, Jr. | 299/1.6 |
| 6,435,619 B1 | * | 8/2002 | Frederick et al. | 299/1.1 |

OTHER PUBLICATIONS

German Patent No. 2,007,817 effective Mar. 4, 1969, issued to George Thomas Addison.

* cited by examiner

*Primary Examiner*—Heather Shackelford
*Assistant Examiner*—Sunil Singh
(74) *Attorney, Agent, or Firm*—Waddey & Patterson; Larry W. Brantley

(57) ABSTRACT

A control system for continuous mining machine to control the mining horizons of roof and floor horizons relative to the rock boundaries of an underground coal seam or ore vein. The mining machine is provided with a cutting drum mounted on a pivoted arm to allow for vertical displacement of the cutter to control the mining height. A plurality of sensors is carried on the rotatable arm to locate the roof and floor boundaries. Attitude sensors are mounted on the machine for providing signals indicative of the inclinations of the body of the machine, and, a microprocessor receives the signals from the boundary sensors and the attitude sensors for calculating the required roof cut and floor cut. A display device receives the signals from the microprocessor and displays the calculated results to the machine operator.

25 Claims, 5 Drawing Sheets

SYSTEM FOR CONTROLLING CUTTING HORIZONS FOR CONTINUOUS TYPE MINING MACHINES

This is a continuation-in-part of U.S. patent application Ser. No. 09/309,772 filed on May 11, 1999, now abandoned.

FIELD OF THE INVENTION

This invention relates to continuous mining machines engaged in the process of extracting mineral, i.e. coal, trona, etc., from an underground seam. More particularly this invention relates to methods and apparatus employed to detect the location of seam boundaries and to guide the machine to achieve the desired cutting horizons (vertical elevations) relative to those seam boundaries.

BACKGROUND OF THE INVENTION

Continuous mining machines typically include a self-powered, tracked vehicle having a rotary arm pivotally mounted at its forward end. A cutter is rotatably mounted at the distal end of the rotary arm to cut into a coal or ore seam for extraction of the coal or ore by an extraction mechanism provided on the machine.

Various patents exist which describe devices utilized in the mining of coal. Most notably the Lipinsky U.S. Pat. No. (4,952,000) which describes the method and apparatus of HIWALL mining. Lipinsky relies on gamma ray detection as a sensor. However, Lipinsky has determined that mining data on the use of the gamma detectors in Lipinky's invention is limited in significant ways. Lipinsky uses gamma detectors ONLY to measure coal thickness that MUST be left at the roof and the floor of the mined highwall holes. Lipinsky further records coal thickness data on one or more holes, creating a profile of that seam, and then applies the resulting vertical control scheme to the machine on the next adjacent hole. He does not use real time data to try and control the machine in any current hole, but relies on the data on the previously recorded hole to assume what will happen ahead of the machine in the current hole. While he is controlling the machine in the current hole, he is recording data to then be applied to the next hole.

Lipinsky has determined that using data on any current hole for controlling the machine in that current hole is inadequate and not useful, due to the fact that no one has derived a good control scheme to predict what is ahead of the miner. The present control scheme has, however, successfully used real-time data to control the machine in the current tunnel, which would be required in normal room and pillar mining operations, as well as entry driving or roadway driving. Entry and roadway driving, along with room and pillar mining are operations that cannot use Lipinsky's data recording scheme, and thus cannot use his control scheme because there is no parallel holes to record data in, to be applies anywhere else. These types of mining require that control be applied while the gamma detectors are being read, and does not require data recording and post processing, as does Lipinsky's scheme.

Additionally, Lipinsky locates his detectors far back on the machine, and limits them to recording coal thickness data. This inhibits the adequacy of any control operation. This scheme also will not work where all coal is removed, and only rock is left at the roof and floor. The small detector scheme of the present invention, where we look for that dust cloud emitting a burst of gamma radiation, works well where all the coal or ore body is being extracted, and leaving only the seam boundary material.

SUMMARY OF THE INVENTION

The present invention addresses the shortcomings in Lipinsky's patent at least in the following ways:

1. The present invention allows control of the miner in real time, and does not require application of previously recorded coal thickness data for control of the miner. Note that data was recorded over a period of hours during mining of the previous hole.
2. The current invention allows full seam extraction leaving only the seam boundary, and does NOT require coal to be left for it to operate, where Lipinsky requires coal to be left for his gamma detectors. These sense the boundary radiation to determine coal thickness, which is used as means of locating the boundary.
3. When the current invention uses a gamma sensor, it can be mounted on the machine anywhere that has a view of the cutter drum and material currently being cut, whereas Lipinsky's invention is limited to being pointed towards roof or floor areas having a previously cut layer of coal.
4. The current invention uses a gamma sensor to determine the boundary by detecting a burst of gamma radiation when the boundary material is contacted by the cutter, and DOES NOT require coal thickness to be left like in the case of Lipinsky. Coal that is required to be left for the Lipinsky approach could be coal that is recoverable with the current approach.
5. The current invention control scheme can use any type of seam interface detector that will provide indication of cutter contact with the rock boundary and is not limited to gamma sensors.

The present invention provides a means to improve the control of cutting the roof and floor during underground extraction of coal or ore from the seam. Such roof/floor control is commonly referred to as "Horizon Control". With each forward advance of the mining machine in the seam, the control system locates the seam boundary(s) and directs the elevation of the machine's cutter relative to the seam's upper and/or lower rock boundary(s). Hence the extraction can be controlled to follow the seam boundary(s), avoiding the mining of rock and also providing control of the extraction height as may be required by the mining operation. Therefore, the control system which includes a microprocessor is capable of controlling either the upper or lower cutting horizons or both, during the mineral extraction process.

Sensors provide information for the system to calculate and determine upper and lower seam boundary locations (vertical elevations), machine attitude and cut profiles for the roof and floor as the machine moves continuously forward in a succession of sumping cycles during the coal or ore cutting operation. This information will be used by machine operators and/or the machine's electro-mechanical control system to position the cutter in the seam or ore vein. The assemblage of components to be installed on the continuous mining machine will be referred to as the Horizon Control System. This system will make possible the cutting of a smoother, more uniform roof and floor, at the desired horizons (vertical elevations).

For reference, a "sumping" cycle for a continuous miner typically consists of the following steps:

1. Raise drum type cutter to the mine roof at the desired height (cutter is mounted on a boom that has a pivot at the opposite end).
2. The machine moves forward with the cutter entering the coal/ore face the selected roof height. The cutter travels or "sumps" in to the coal/ore a distance of ½ to ⅔ of its diameter.

3. The arm and the cutter are then lowered, cutting coal or ore from the face, until the cutter reaches the desired floor level. This is called the "downcut".
4. The machine then backs up to grade the floor and clean up (load) loose coal or ore into the shovel's gathering head.
5. Cycle then repeats itself as the machine moves forward through the seam.

The Horizon Control System is installed on the continuous mining machine. It displays "real-time" guidance information to assist continuous miner operators in positioning the cutter head for desired roof and floor cuts or may be setup to automatically control positioning of cutter head through the miner's electro-hydraulic controls. Using information from multiple sensors, the system provides an "intelligent" display of cutter height, measured from either the last cut floor or the next floor cut during a new sump cut. The display unit also indicates when the cutter has reached the required position for either the next roof or floor cut. However, the machine operator cannot always watch the display unit because he is also involved with other tasks occurring simultaneously, such as loading coal/ore transport vehicle. Therefore, when the cutter has reached the required position, a separate bright "target light" is illuminated to notify operator to stop the cutter vertical travel. Alternately, as previously mentioned, the system's microprocessor may direct the machine's controls to stop cutter travel, in addition to turning on the "target light".

An Operator Interface Display Unit provides the means to display system information such as cutter height sensor values, calibration parameters, error conditions or other system operational information. The displays are controlled by the microprocessor. Displayed values may be in either English or Metric units. Prior to the new sump cycle, cutter height is displayed from the last floor cut. After the roof is cut and the sump down cycle is in progress (shearing coal/ore from the face); cutter height will be displayed to the operator as a distance relative to the new floor target. When the cutter arrives at the new target floor or floor cut position, the "target light" will be turned on and the cutter travel will be stopped by the operator or by the system microprocessor.

Other features of the system are provided to facilitate setup, calibration and checkout. These include:

1) Switch or Key Pad Unit for entry of variable parameters into the system, such as machine geometry dimensions, mining requirements, calibration factors, limit settings, etc.
2) A Crawler Plane LED on the Operator Interface Display to be used as an aid in system calibration and checkout. When lit, the LED on the Operator Interface Display is used as an aid in system calibration and checkout. When lit, the LED indicates when the bottom of cutter is at the crawler plane reference. The crawler plane is a theoretical plane formed by bottom of the crawler treads on the left and right crawlers of the mining machine and projected forward to the cutter. It is noted that the vertical distance of cutter from projected crawler plane is an important geometric reference for the control system and is used in the calculation of cutter height (elevation).
3) An attitude sensor, such as an inclinometer, to measure machine roll (left to right inclination) that electronically controls an illuminated indicator on the display unit, providing a qualitative level at predetermined degree increments. External means can be used to re-level the machine based on the roll level display indicator.

HORIZON CONTROL SYSTEM OPERATION

A number of mining strategies may be used to extract the mineral from the underground seam, depending upon conditions. Choice of boundary sensors and control logic for cutting will vary with each of these strategies and seam geology. The most common extraction strategies, or Cases, are:

1. Full Seam Extraction of the mineral between upper and lower seam boundaries.
2. Partial Extraction and the leaving of residual mineral at one or both seam boundaries.
3. Minimum Height Extraction, taking all of the mineral and part of one or both boundaries.
4. Constant, Variable or Minimum Extraction Height as applied to above Cases 1, 2 and 3.

Sensors to Detect Coal Seam Boundaries

The horizon control system may utilize sensors of different types to detect the upper and lower seam rock boundaries, including such types as gamma, electromagnetic radiation, vibration, sonic, pick force, cutter motor current and optical reflectivity or imaging. The purpose of detecting and locating the seam boundaries is to be able to accurately control extraction of all or a desired portion of the coal seam and in certain situations to accurately control the amount of boundary rock taken. The latter would be true in low seams requiring rock removal to obtain additional height for equipment clearance.

In mining situations where all of the coal or ore is extracted from the given seam, i.e., none is left at the seam boundary, sensors must be able to detect when the cutter approaches or contacts the boundary. The cutter will rapidly (e.g. 3 to 5 inches per second) approach the boundaries in a vertical direction (normal to the plane of the boundary). In order to stop the cutter before or at the boundary, it is required that a stop command be issued to the hydraulic controls while the cutter is still several inches away from the boundary. In this mining environment, presently known sensors are not capable of detecting the boundary when the rapidly approaching cutter is still several inches away. However, it is possible for these sensors to detect when the cutter contacts the boundary. With that information, it is now possible to accurately determine the location (elevation) of the seam boundaries and to compute the desired horizon (elevation), relative to those boundaries, for the next roof and/or floor cuts made as the machine advances. Control methodology will be discussed later.

A small compact Gammna Sensor is one of the primary sensors that will be employed by the system to detect the cutter with a rock boundary. It can be used where boundary rock emits gamma radiation that is significantly different than that of the coal or ore in the seam. For example, usually the gamma radiation from common boundary rock materials such as shale or fire clay will be significantly higher that from the coal.

The system will utilize one or more gamma sensors to detect the rock boundary material. The gamma sensors may be placed in any location that will afford a view of the cutter and the material being cut. As the cutter approaches the roof or floor rock boundary (emitting gamma) the previously mined and exposed boundary may come into the sensor's view increasing the amount of radiation detected. Also, additional radiation may be present to the gamma sensor, coming from the yet unexposed boundary directly above or below the cutting drum. As the cutter approaches the boundary, the coal between the boundary and the cutter becomes thinner allowing increased radiation from the boundary to reach the sensor. Some of this radiation will pass through the space between the spiral flutes of the cutting drum. Therefore, the total amount of radiation may further increase as the cutter nears the floor, providing an "early warning" of the cutter approach to the floor. If the warning is sufficiently early, it may allow stopping of the cutter before it contacts the floor.

Alternately, another approach has been devised, that has proven in operation to be very reliable. In this approach, when the cutter contacts the floor a dust cloud made up of rock particles is generated by the cutting bits (teeth). Relatively high-energy gamma radiation is released by the dust cloud causing the sensor electrical output (gamma counts) to rise sharply (spike) in comparison with the previous sensor readings. This indicates to the system processor the time of boundary contact and the location (elevation) of the boundary. The system's microprocessor will use this information for the control of subsequent cutting, as will be described later.

Control Methodology

The control process for machine operation is described as follows:

1. Machine cutter's vertical travel is stopped at a programmed (pre-determined) target height relative to the last known height (vertical elevation) of the seam boundary.
2. During cutter's vertical travel (before being stopped) and as it approaches the seam boundary, sensors of various types will detect the proximity of or contact with the seam boundary.
3. If detected, the boundary's vertical location can then be defined as a distance relative to machine cutter's vertical location or height.
4. If boundary is not detected, then the last known boundary location (e.g. last cut) will be used.
5. Information as to the present and/or past location of the seam boundary is then used to calculate (estimate) the vertical target height for stopping the cutter on the next forward cutting cycle, that being a point approximately 2 feet forward of the machine's current location.
6. The process is then repeated for each cutting cycle as the machine advances into the seam.

From the sensor information obtained in steps (3) and (4) above, it can be determined if the cutter has stopped at a point too low, too high or that is correct in relation to the seam boundary. In the event that the cut was too low, the target height (elevation) for the next cut cycle will be raised, or if the cut was too high, the target for the next cut will be lowered.

The horizon control system may use cutter elevation information to achieve limited horizon control where it is not possible to employ seam boundary sensors, such as gamma radiation or other types of detectors. This could happen if geological conditions for the mine would render boundary sensors ineffective. In this case the machine operator must be able to determine the location of at least one of the seam boundaries, i.e., either the upper or lower boundary rock. Using the cut elevation as adjusted and executed by the machine operator, the system then determines the location of the required next roof and floor cuts, using criteria determined as appropriate for the existing mining situation. As previously mentioned, when the cutter arrives at the required roof or floor cut position, the system may inform the operator by illuminating a "target light" and/or automatically stop vertical travel of the cutter. At this point, if the operator further adjusts the cut elevation, this information will be used by the system in the determination of the required roof and floor heights for the next cycle.

It is noted that the process described herein will provide significant economic, environmental and worker health and safety benefits. The ability to guide the mining machine to extract only the desired part of the mineral seam will reduce rock dilution and other contaminants, e.g., sulfur, producing a cleaner more environmentally acceptable product. This will be particularly important to the coal industry and U.S. National energy goals.

It is an object of the present invention to provide a method and apparatus for increasing the efficiency of a continuous type mining machine.

It is a further object of the present invention to increase such efficiency by detecting the location of the seam boundaries and to guide the machine to achieve the desired cutting horizon (vertical elevations) relative to these seam boundaries.

In accordance with a preferred embodiment of the present invention there is provided a method and operation where the machine tracks and detects the location of the interface of the seam of coal and rock boundary of (The term "rock" has been used to describe various types of boundaries in the coal seam). Data is received by the microprocessor that indicates that the detection has occurred and the microprocessor transmits this information to the control mechanism of the machine.

These and other objects and advantages of the present invention will become more readily apparent from the following detailed description when taken in conjunction with the accompanying drawings, specification and claims.

DETAILED DESCRIPTION OF THE PREFERRED EMBODIMENTS

Figure 1:
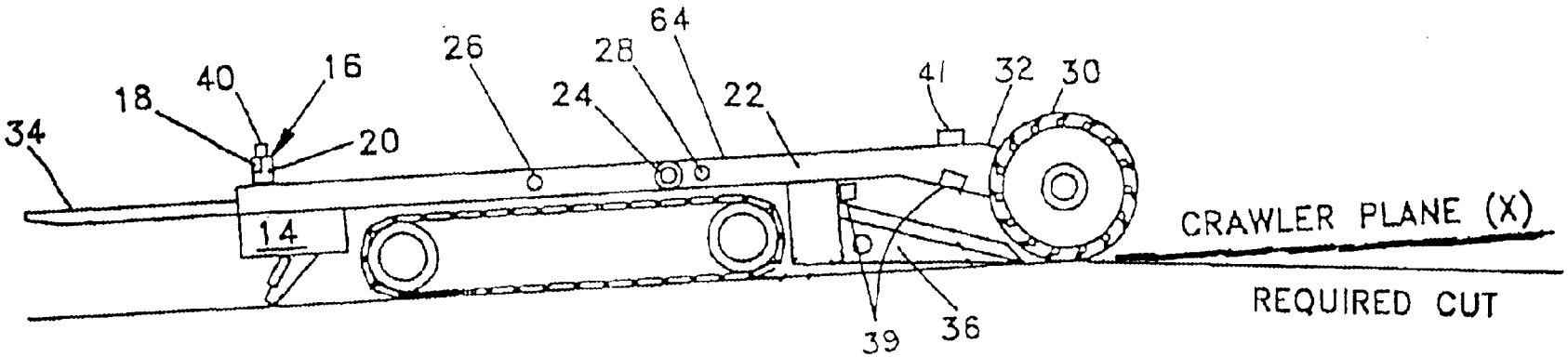
FIG. 1 is an elevation view of a continuous mining machine as a cut is made into a coal seam. The vertically displaceable cutting arm of the machine that supports a rotary cutter at its distal end is shown in its lower position. The machine is illustrated as moving along a crawler plane "X" which is illustrated in inclined relation with the plane in which the required cut is required.
Figure 2:
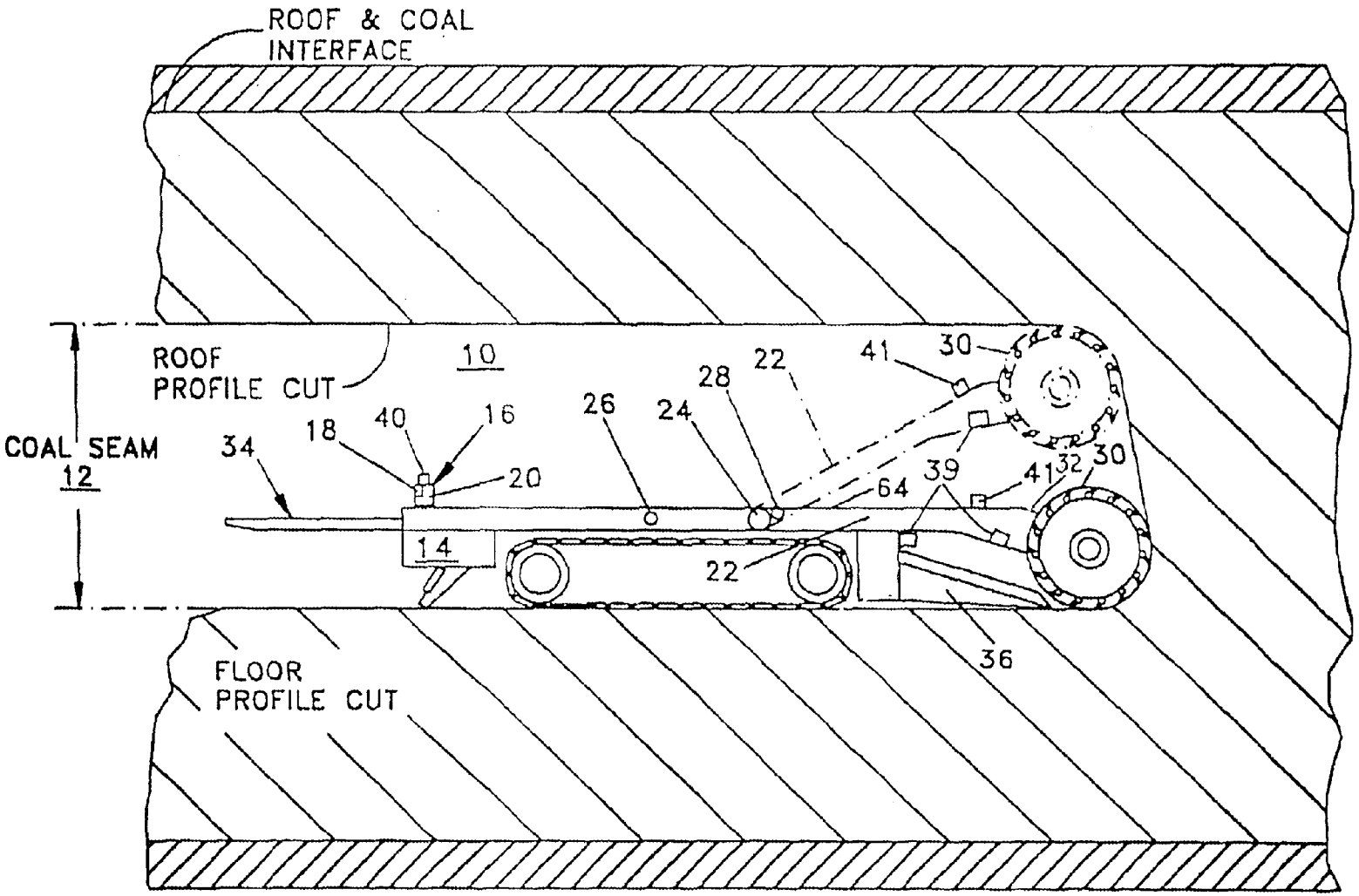
FIG. 2 is an elevational view similar to FIG. 1 but illustrates the vertically displaceable cutting arm and cutter in upper and lower cutting positions. The dot-dash illustration of the cutting arm and cutter shows the upper position. In this view the "required cut" plane and the crawler plane are coincident.

As seen in FIGS. 1 and 2, a tunnel 10 is cut through a coal seam or ore vein 12 by a continuous mining machine 14. The mining machine is referred to as a continuous mining machine since it continuously moves forward through the seam or vein by means of successive sump and cut cycles.

The continuous mining machine 14, typically includes a cutter arm 22 which is pivotally mounted to machine 14 at pivot 24 for up and down movement around the pivot 24. A rotary cutter 30 is mounted on the distal end 32 of arm 22 for removing coal/ore from the seam, and as the coal/ore is being cut it is carried behind the machine by a conveyor system designated by the numeral 34, having a shovel and gathering head 36 at the forward end thereof.

Figure 3:
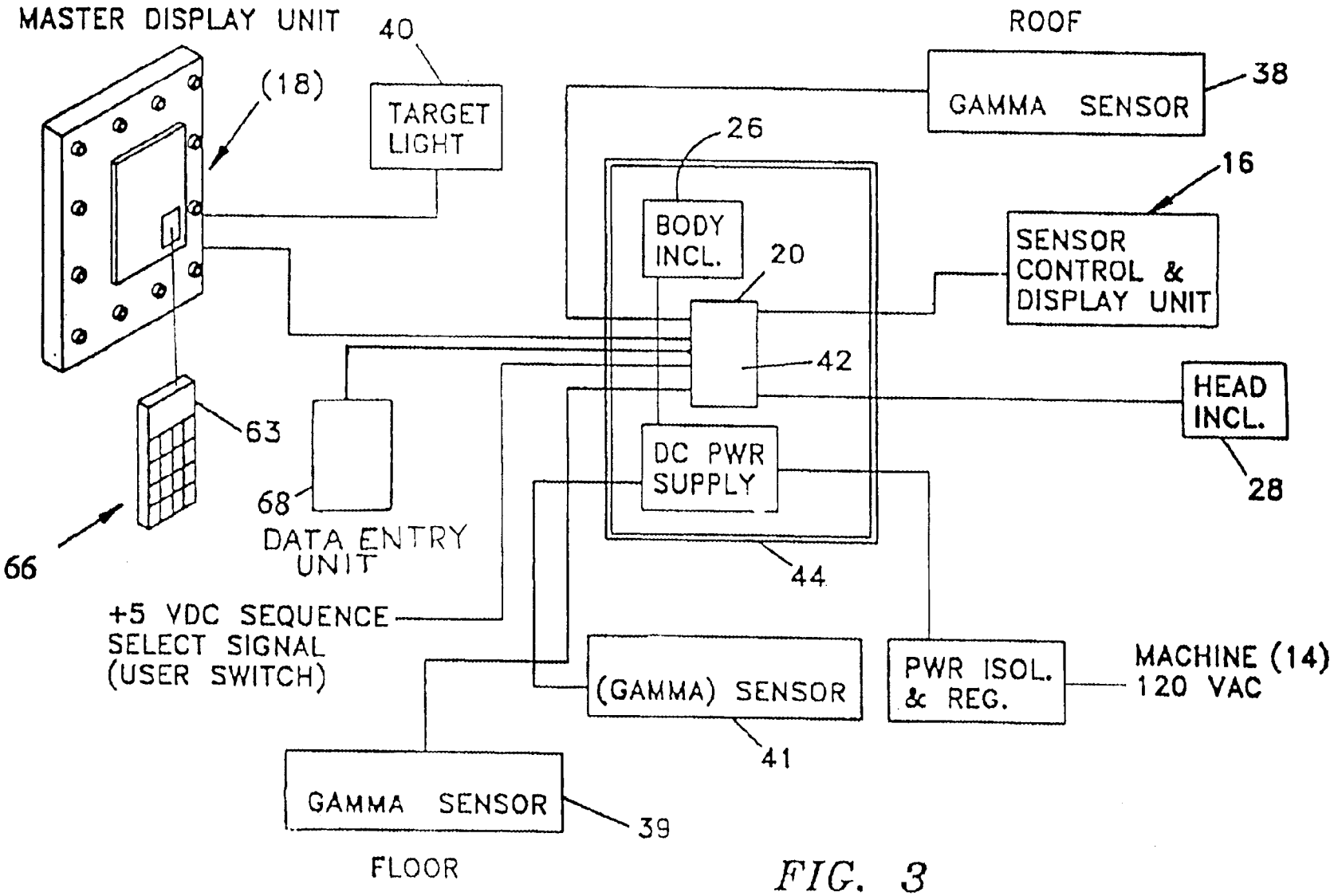
FIG. 3 is a schematic diagram of the horizon control system that is installed on the mining machine of FIG. 1.

A horizon control system is installed on a continuous mining machine 14, and typically includes the following components as shown in FIGS. 1, 2 and 3. A Master Display and Processor Unit 16, including a display 18 and a processor 20 which provides the intelligence for operation of the system. An operator data entry unit 64 provides data access to the processor 20. Angle transducers such as inclinometers 26 and 28 are respectively mounted on body of machine 14 and arm 22 to provide both machine pitch and cutter position (arm angle) data to processor 20. The connection box assembly 44 (FIG. 3) connects all of the cables from separately located system component assemblies and also may contain additional signal condition, intrinsically safe barrier, tilt transducer inclinometer 26 and power components. A separately mounted target light 40 may be connected to connection box 44.

Small compact Gamma Radiation Sensors 39 and 41 (which are similar) and are in the preferred embodiment may be mounted to the apparatus and is mounted in view of the cutter (line-of-sight) at the roof or floor cut. The gamma sensor is of a compact design, which permits its installation close to the cutter allowing control of cutting at seam boundaries in mining situations where it is not practical to leave coal/ore thickness at the boundaries.

Cutter Height Determination: A tilt transducer such as inclinometer 26 measures machine body pitch, i.e., angle of machine body, front to rear. A second inclinometer 28 measures the angle of the cutter arm 22. A change in the projected crawler plane elevation, at the cutter horizontal location, is calculated as a result of the variance in body pitch angle about gravity level. This value is then added to the distance of cutter center to crawler plane to obtain the total cutter height. The radius of the cutter is either added or subtracted from the height of the cutter center to provide height to bottom (floor cut) or top of cutter (roof cut). A linear offset is then applied to make the height value zero. The height values generated by the microprocessor 20 are sent to the display unit 18, to display the cutter 30 height (in English or Metric units). Height is calculated as a distance from the last floor cut, when raising cutter to the roof and during the roof sump cut. After the cutter is sumped in and starts its downward motion toward the floor, the cutter height may be displayed on 48 (FIG. 4) as the distance from the new (target) floor cut elevation.

Horizon Control Modes

Compact (small) Gamma Radiation Sensors 39 and 41. The following describes preferred apparatus operation of cutting relations to seam boundaries using gamma sensor 39 and 41 specifically mounted on the pivotal arm, as described herein. Sensor 41 is shown mounted on the upper surface of arm 22 adjacent to the cutter to detect gamma ray signals from the roof and gamma ray sensor 39 is shown mounted on the under surface of arm 22 in proximity of the forward distal end of arm 22. Sensors 39 and 41 are to be mounted in line-of-sight with the cutter. It is to be understood that these sensors may be mounted on the machine in position other than shown. However, it is necessary that the sensors be mounted in a position that will afford a view of the cutter and the material being cut.

Constant Height Control of Roof Cut: In the portion of the cycle where the cutter 30 is raised for the roof cut, the processor 20 compares the cutter height with the required roof cut height that was entered into the processor's memory as a user defined parameter. When the cutter reaches the required roof cut height, the target light 40 illuminates to alert the operator to stop cutter's upward motion. Target light will be turned off following the roof sump and start of cutter downward motion.

Figure 4:
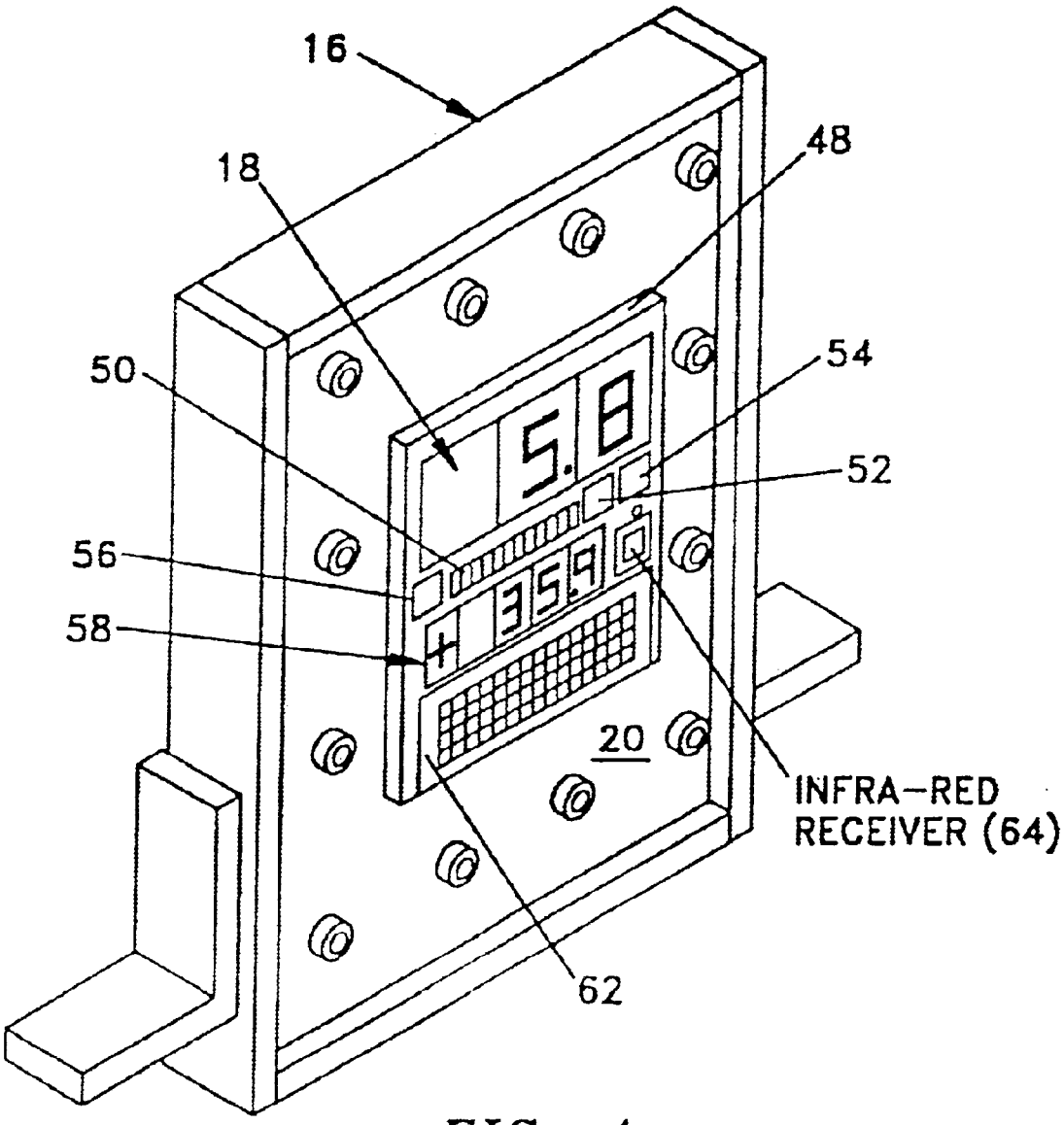
FIG. 4 is an enlarged view of the master display of the control panel.

Constant Height Control of Floor Cut: After the cutter is sumped in at the roof and starts its downward motion toward the floor, the processor 20 calculates the required new floor cut elevation for on-going sump cycle. The processor 20 utilizes; the elevation of the last floor cut and user entered parameters, including the constant height value required, to calculate the new floor cut elevation. The required new cut will be constrained to a defined tolerance from the last floor cut elevation. Following this calculation, the cutter height is displayed on 48 (FIG. 4), as the distance from the new floor cut elevation. Processor 20 compares cutter height with required new floor cut elevation and informs the operator that the cutter is nearing the new calculated correct floor position by a message on the alpha-numeric display 18 (FIGS. 4 and 62, FIG. 3). Target light 40 illuminates to alert operator to stop cutter's downward motion when cutter 30 has reached the required floor cut position.

Master Display & Processor Unit 16 (master unit), shown in FIG. 4, includes display unit 18 and processor 20. FIG. 4 is an enlarged view of display unit 18. Displays provided include cutter height indicator 48, (English or Metric Units), a machine 14 roll indicator 50, cutter at crawler plane indicator 52, a sensor data condition error indicator 56, and a vacuum fluorescent display 62 together with an infrared receiver 64 to receive IR signals from a remote transmitter 66 or from hard wired data entry unit 68 (FIG. 3), are used for the entry of data parameters to processor 20.

Operation

In operation with each forward advance of the mining machine in the seam, the control system locates the seam boundary(s) and directs the elevation of the machine's cutter relative to the seam's upper and/or lower rock boundary(s). Hence the extraction can be controlled to follow the seam boundary(s), avoiding the mining of rock or alternatively leaving a desired amount mineral at the seam boundary(s) and also providing control of the extraction height as may be required by the mining operation. Therefore, the control system is capable of controlling the either upper and lower cutting horizons or both, during the mineral extraction process. The function of the system relates to the techniques and process employed to detect the location of seam boundaries and to guide the machine to achieve the desired cutting horizons (vertical elevations) relative to those seam boundaries.

Description of Control Process (1) Machine cutter's vertical travel is stopped at a programmed target height relative to the last known height (vertical elevation) of the seam boundary. (2) During cutter's vertical travel (before being stopped) and as it approaches the seam boundary, sensors of various types will look for and detect the presence or contact of cutter 30 with the seam boundary. (3) If detected, the boundary's vertical location can then defined as distance relative to machine cutter's vertical location or height. (4) If boundary is not detected, then the last known boundary vertical height will be used. (5) Information as to the present and/or past location of the seam boundary is then used to calculate (estimate) the vertical target height for stopping the cutter on the next forward cutting cycle, that being a point approximately 2 feet forward of the machine's current location. (6) The target cut height calculation is based upon pre-defined parameters for the cutting operation. (7) The process is then repeated for each cutting cycle and machine advance into the seam.

From the sensor information obtained in steps (3) and (4) above, it can be determined if the cutter has stopped at a point too low, too high or that is correct in relation to the seam boundary. In the event that the cut was too low, the target height for the next cut cycle will be raised.

Detection of Seam Boundary

The seam boundary is detected by one or more sensors of the same or different types, i.e., gamma, cutter vibration, acoustic or cutter motor current. Choice of sensors is dependent upon the insitu geology and/or seam conditions. For example, soft rock (fire clay) floor boundaries can be detected with gamma sensors, but not by vibration or other types. Hard shale rock floor or roof boundaries can be detected by one or more of the above sensors. In any event, the specific choice of sensors would depend upon the boundary rock characteristics and other site related factors.

The system employs a unique process for recognizing and locating the seam boundary and subsequently controlling the machine's cutting in relation to that boundary. What is key to detection of the rock is a recognizable characteristic of the sensor signal when the cutter approaches the rock boundary or is at the boundary. The process is not obvious. High-speed mathematical interpretation of the sensor signal characteristics is necessary, requiring a fast computer processor. To illustrate, the process for detection of a soft fire clay lower seam boundary that naturally emits gamma radiation is described as follows:

1. When the cutter intersects the soft rock (fire clay) boundary, particles are scrapped off by the cutting bits of the rotating cutter drum, creating a dust cloud behind the cutter. During its brief existence, the dust cloud emits high intensity gamma radiation that is detected by the gamma radiation into light (photons) that are converted to electrical impulses, referred to as "counts". Counts per unit time, i.e., counts/second are proportional to the intensity of gamma radiation. The dust cloud results in a sharp rise in the counts per second value of the electrical signal. The gamma sensor may be installed in any location that affords the opportunity to "view" and receive gamma radiation from the rock dust cloud. The presence of the dust cloud and the resulting sharp rise in gamma radiation is a positive indication that the cutter has reached the seam boundary.
2. At any particular instant, the intensity of radiation from any gamma source varies in a statistical manner as depicted in a standard distribution "bell curve". This means that gamma data must be averaged to avoid an excessively high or low reading which could be misinterpreted. Therefore, the rise in the gamma signal from the dust cloud is calculated from an average of at least three consecutive readings. The average gamma signal rise is then compared to the average gamma signal detected prior to the cutter reaching the lower seam boundary (mine floor). This last average, taken during several inches of cutter travel as it nears the floor, is comprised of radiation received from floor and roof rock, as well as other sources, such as in-seam rock binders. If it were not averaged, spurious high gamma readings could be prematurely interpreted as the rise from cutter contact with the floor. A minimum gamma rise criterion, set by adjustable system parameters, insures reliable detection of cutter contact with the floor boundary.
3. The vertical elevation or cutter height is also calculated and noted by the processor at the time sharp gamma rise (cutter contact with the floor). The cutter height is calculated from data provided by attitude sensors also installed on the mining machine and described elsewhere. This information now relates the seam boundary to cutter height, hence determining its location relative to the mining machine.
4. A valid gamma rise at contact of cutter with the floor is referred to for convenience as "gamma detect". Should no gamma signal rise be detected in a particular cutting cycle, up until the time the cutter is stopped, the result will be interpreted as the cutter vertical travel having been stopped prior to its contact with the floor boundary. This is referred to for convenience as a "no detect" event. The evidence of gamma detect or no detect, the seam elevation and the cutter height information are used by the control algorithm to adjust the target cut height for the next forward cutting cycle, that may also be referred to as the next sump.
5. A typical rise occurs in gamma signal (counts) upon cutter contact with the rock floor. The amount of rise or increase in the signal can vary considerably, thus requiring the system parameters that can be adjusted to fit existing or changing conditions.

Signal Processing & Control Logic Algorithms

Signal processing and control logic operations are performed by a high-speed computer processor. Inputs to the processor include machine body pitch, cutter head arm angle, cutter motor current and one or more boundary interface sensors. From this data the processor calculates machine attitude, cutter height, vertical elevation of seam boundaries relative to the mining machine and floor and/or roof cutting height targets for the next forward cutting cycle. The computer also controls the vertical travel of the cutter, stopping travel at the required cutting height target locations. Control procedures used for a typical cutting cycle (forward sump) are described as follows:

1. The height of the cutter is the distance from either the present or next forward target floor height. It is calculated as a function of machine body pitch and cutter arm angle. The height value is continuously calculated for use by the control software logic program and is also displayed visibly to the machine operator.
2. Boundary sensor data taken during the cutting cycle is evaluated by the software program to determine if the boundary has been detected and located or that there has been no detection of the boundary.
3. If the rock boundary has been detected, meaning that either near approach to the boundary is recognized or that the cutter 30 has come in contact with the rock, the program calculates a new target cut height for the next forward cycle that positions the cutter in a direction away from the rock. If there has been no detection of the boundary, then the cutter target height (next cycle) is positioned toward the rock boundary. This is accomplished by adding or subtracting a pre-determined amount to the present target cut height value. The amount of increase or decrease is set by parameters entered into the computer.

It is to be understood that the processor 20 used herein may utilize microprocessors of several types such as RCA 1805, Motorola 68,8000, Intel X86 or Intel Pentium family of microprocessors.

It is to be understood that Inclinometers 26 and 28 may be a number of types of attitude measuring devices, using different means to sense changes in inclination or direction. For example, such other types may use weighted pendulum coil element, force balance or inertial principles for means of operation.

It is to be understood that Gamma Sensors 39 and 41 used to locate the boundaries of the coal/ore seam may be replaced with other suitable sensors as may be appropriate for the conditions. For example, such other types may use electromagnetic, optical, vibration or force principles as a means to detect the boundaries.

It is to be also understood that Gamma Sensors are well known in the art. One gamma sensor is disclosed in U.S. Pat. No. 5,334,838, issued on Aug. 2, 1994 and assigned to American Mining Electronics, Huntsville, Ala. which is incorporated herein by reference.

It is further understood that pivoted arm movement is controlled by fluid actuators to position the arm and cutter. Such systems are well known in the art and includes hydraulic cylinders and pistons connected by hydraulic lines which are connected to a source of hydraulic fluid. Solenoid valves are utilized to control the flow of fluid to the actuators and the solenoid valves are connected to the control panel actuated by the operator or the computer.

Control Methodology

Figure 5:
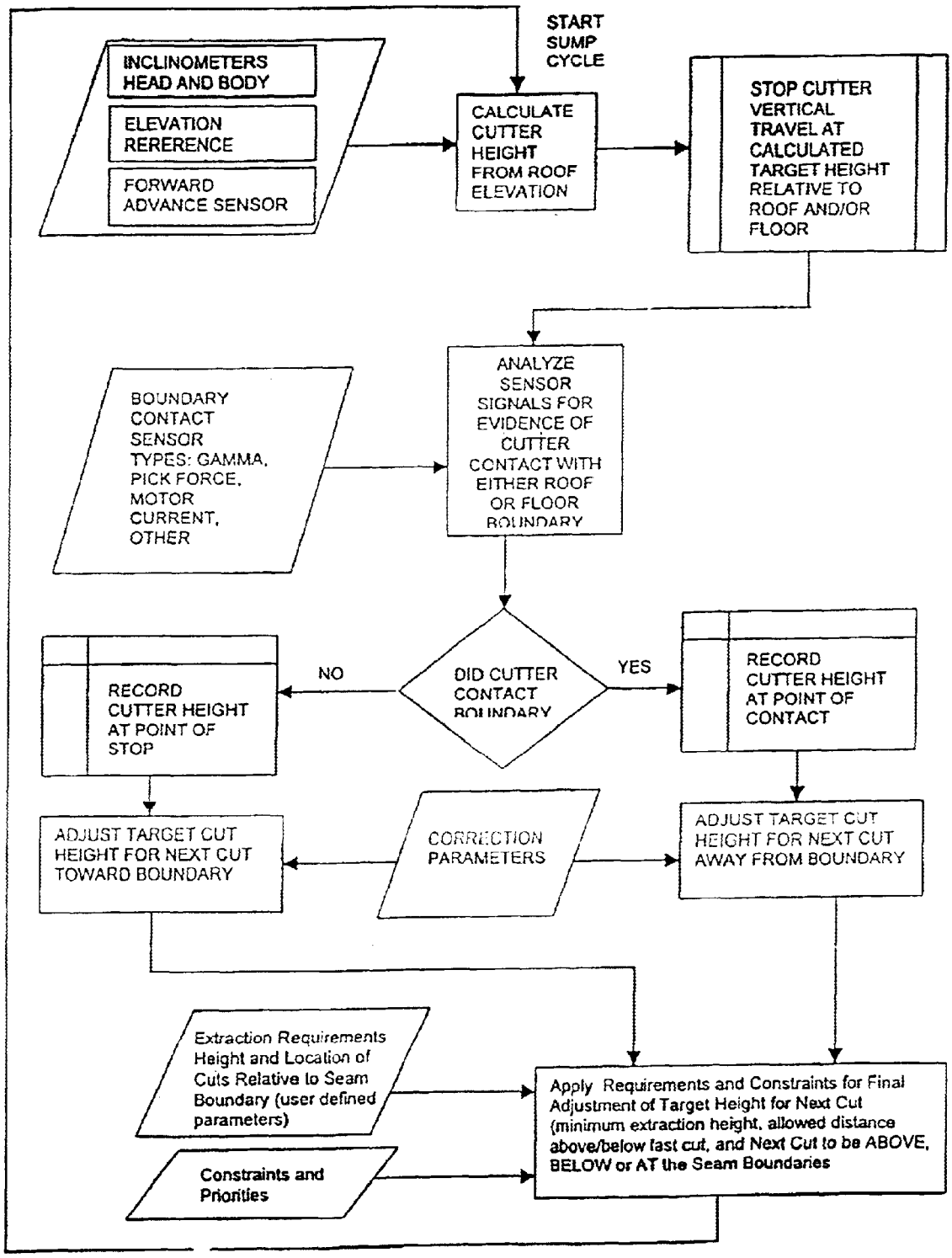
FIG. 5 is a logic diagram illustrating the operation of the system of the present invention.

Referring to FIG. 5 drawing, logic flow chart of the control process that utilizes sensors to detect the coal seam rock boundaries is illustrated. The control process is described as follows:

1. Machine cutter's vertical travel is stopped at a programmed target height relative to the last known height (vertical elevation) of the seam boundary.
2. During cutter's vertical travel (before being stopped) and as it approaches the seam boundary, sensors of various types will look for and detect the presence of the seam boundary.
3. If detected, the boundary's vertical location can then be defined as a distance relative to machine cutter's vertical location or height
4. If boundary is not detected, then the last known boundary location will be used.
5. Information as to the present and/or past location of the seam boundary is then used to calculate (estimate) the vertical target height for stopping the cutter on the next forward cutting cycle, that being a point approximately 2 feet of the machine's current location.

It is to be understood that Gamma Sensors are well known in the art. One gamma sensor is disclosed in U.S. Pat. No. 5,334,838, issued on Aug. 2, 1994 to the present inventors and assigned to American Mining Electronics, Huntsville, Ala. which is incorporated herein by reference.

It is further understood that pivoted arm movement is controlled by fluid actuators to position the arm and cutter. Such systems are well known in the art and includes hydraulic cylinders and pistons connected by hydraulic lines which are connected to a source of hydraulic fluid. Solenoid valves are utilized to control the flow of fluid to the actuators and the solenoid valves are connected to the control panel actuated by the operator or the computer.

We claim:

1. A system for controlling a mining machine, comprising:

a seam boundary sensor adapted to be mounted on the mining machine, the sensor further adapted to sense energy emissions and to generate a sensor output indicative of sensed energy emissions; and a control system adapted to be mounted on the mining machine in communication with the seam boundary sensor and to detect a seam boundary located between and formed by material to be mined and undesirable material not to be mined, the control system adapted to detect the seam boundary by monitoring the seam boundary sensor output and to generate a seam boundary signal indicating that the seam boundary has been reached when the seam boundary sensor generates a sensor output indicating that a seam boundary energy emission has occurred, the seam boundary energy emission being caused by mining of undesirable material forming part of the seam boundary.

2. The system of claim 1, wherein the seam boundary energy emission is greater than energy emitted from the undesirable material when the undesirable material is not being mined.

3. The system of claim 1, wherein the seam boundary energy emission is greater than energy emitted from the undesirable material when approximately all of the material to be mined is removed from the undesirable material.

4. The system of claim 1, wherein the seam boundary energy emission is created by a dust cloud of particles of the undesirable material caused by mining of the undesirable material.

5. The system of claim 1, wherein the seam boundary energy emission is an energy spike.

6. The system of claim 1, wherein the seam boundary energy emission is a gamma radiation energy emission.

7. The system of claim 1, wherein:

the material to be mined includes coal; and the undesirable material not to be mined includes shale or fire clay.

8. A method of controlling a mining machine, comprising the steps of:

sensing energy emissions during mining operations performed by the mining machine using a sensor mounted on the mining machine;

generating sensor outputs indicative of the sensed energy emissions using the sensor;

monitoring, using a computer system mounted on the mining machine and in communication with the sensor, the sensor outputs to determine when a seam boundary located between material to be mined and undesirable material not to be mined has been reached;

generating, using the computer system, a seam boundary signal indicating that the seam boundary has been reached when the sensor generates a sensor output indicating that a seam boundary energy emission, caused by mining of the undesirable material forming part of the seam boundary by the mining machine, has occurred.

9. The method of claim 8, wherein the step of generating the seam boundary signal includes the step of calculating an average value of a plurality of sensor outputs associated with the seam boundary energy emission.

10. The method of claim 9, wherein the step of generating the seam boundary signal further includes the steps of:

calculating an average value for a plurality of sensors outputs occurring prior to the sensor outputs associated with the seam boundary energy emission; and generating the seam boundary signal if the average value of the plurality of sensor outputs associated with the seam boundary emission exceeds the average value of the plurality of sensor outputs occurring prior to the sensors outputs associated with the seam boundary energy emission.

11. The method of claim 8, further comprising the steps of:

sending the seam boundary signal to an operator display unit mounted on the mining machine in communication with the computer system; and displaying an indication that the seam boundary has been reached using the operator display unit.

12. The method of claim 11, further comprising the steps of:

automatically sending the seam boundary signal to mining controls mounted on the mining machine in communication with the computer system; and automatically causing the mining machine to stop mining using the mining controls in response to the seam boundary signal.

13. The method of claim 11, further comprising the steps of:

calculating a position of a cutter apparatus mounted on the mining machine relative to the seam boundary using the computer system; and displaying the position of the cutter apparatus relative to the seam boundary using the operator display unit.

14. The method of claim 13, wherein the step of calculating the position of the cutter apparatus includes the steps of:

measuring a position of the mining machine relative to a mining machine plane extending from the mining machine to the cutter apparatus using attitude sensors mounted on the mining machine;

using the computer system to compensating for any tilt between the position of the mining machine and the mining machine plane.

15. The method of claim 8, further comprising the steps of:

calculating, using the computer system, a position of a cutter apparatus mounted on the mining machine relative to a prior cut made by the cutter apparatus; and displaying the position of the cutter apparatus relative to the prior cut using the operator display unit.

16. The method of claim 8, further comprising the steps of:

calculating, using the computer system, a desired cut level for a cutter apparatus mounted on the mining machine that is a predetermined distance from the seam boundary; and calculating, using the computer system, a position of the cutter apparatus relative to the desired cut level; and displaying the position of the cutter apparatus relative to the desired cut level using the operator display unit.

17. The method of claim 16, further comprising the steps of:

determining that the cutter apparatus has reached the desired cut level using the computer system; and displaying an indication that the cutter apparatus has reached the desired cut level using the operator display unit.

18. The method of claim 17, further comprising the steps of:

automatically causing the cutter apparatus to stop cutting when the computer system determines that the cutter apparatus has reached the desired cut level.

19. A mining machine, comprising:

a seam boundary sensor mounted on the mining machine and operable to sense energy emissions during mining operations performed by the mining machine, the sensor further operable to generate sensors outputs based on the sensed energy emissions;

a computer system mounted on the mining machine and in communication with the seam boundary sensor, the computer system operable to monitor the sensor outputs generated by the sensor and to determine that a seam boundary located between material to be mined and undesirable material not to be mined has been reached when the sensor generates a sensor output indicating that a seam boundary energy emission has occurred, and wherein the seam boundary energy emission includes an energy spike created by a dust cloud of particles of the undesirable material created when the mining machine begins cutting the undesirable material forming part of the seam boundary.

20. The mining machine of claim 19, wherein:

the mining machine includes a cutter apparatus operable to be positioned at a plurality of different heights relative to the seam boundary and operable to mine the material to be mined and the undesirable material; and the computer system is operable to calculate and display a position of the cutter apparatus relative to the seam boundary to the operator.

21. The mining machine of claim 20, wherein the computer system is operable to calculate and display a position of the cutter apparatus relative to a prior cut made by the cutter apparatus to the operator.

22. The mining machine of claim 20, wherein:

the computer system is operable to calculate a desired cut level for the cutter apparatus that is a predetermined distance from the seam boundary; and the computer system is operable to calculate and display a position of the cutter apparatus relative to the desired cut level to the operator.

23. The mining machine of claim 22, wherein the computer system is operable to display an indication to the operator that the cutter apparatus has reached the desired cut level.

24. The mining machine of claim 23, wherein the computer system is further operable to automatically stop the cutter apparatus from moving past the desired cut level.

25. The mining machine of claim 19, wherein:

the seam boundary sensor is further operable to sense non-seam boundary energy emissions through a layer of the material to be mined covering the seam boundary; and the computer system is further operable to receive sensor outputs from the seam boundary sensor indicating the non-seam boundary energy emissions have been sensed, to calculate a position of the mining machine relative to the seam boundary based on the non-seam boundary energy emissions, and to display the position of the mining machine relative to the seam boundary to the operator.

* * * * *